US010270191B1

(12) United States Patent
Li et al.

(10) Patent No.: US 10,270,191 B1
(45) Date of Patent: Apr. 23, 2019

(54) PLUG AND CONNECTOR ASSEMBLY

(71) Applicant: LUXSHARE PRECISION INDUSTRY CO., LTD., Shenzhen, Guangdong Province (CN)

(72) Inventors: Tiesheng Li, Shenzhen (CN); Long Jin, Shenzhen (CN); Qiongnan Chen, Shenzhen (CN); Zhaolong Zeng, Shenzhen (CN)

(73) Assignee: LUXSHARE PRECISION INDUSTRY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/236,776

(22) Filed: Dec. 31, 2018

Related U.S. Application Data

(63) Continuation-in-part of application No. 15/923,025, filed on Mar. 16, 2018, now Pat. No. 10,205,256.

(30) Foreign Application Priority Data

Mar. 16, 2017 (CN) ..... 2017 2 0258731 U
Apr. 1, 2017 (CN) ..... 2017 2 0443445 U

(51) Int. Cl.
*H01R 12/00* (2006.01)
*H01R 12/70* (2011.01)
*H01R 12/77* (2011.01)

(52) U.S. Cl.
CPC ..... *H01R 12/7005* (2013.01); *H01R 12/7023* (2013.01); *H01R 12/777* (2013.01)

(58) Field of Classification Search
CPC ..... H01R 12/7005; H01R 12/7023; H01R 12/777
USPC ..... 439/62, 77, 374, 630
See application file for complete search history.

(56) References Cited

U.S. PATENT DOCUMENTS

2018/0269607 A1* 9/2018 Wu ..... H01R 12/7005

* cited by examiner

*Primary Examiner* — Khiem M Nguyen
(74) *Attorney, Agent, or Firm* — Birch, Stewart, Kolasch & Birch, LLP

(57) ABSTRACT

Provided is a plug and a connector assembly, which belong the technical field of connectors. The plug includes an insulating body, a cable and a circuit board. The insulating body includes a body part and a mating part which extends forwardly from the body part. The cable and the circuit board are electrically connected. The circuit board has an inserting part which protrudes forwardly out of the mating part. An outer side of the mating part is provided with a limiting groove and a guiding wall disposed within the limiting groove, and the guiding wall is adjacent to the inserting part and is capable of guiding insertion of the plug into a socket and preventing the plug from shaking in an up-down direction and/or in a left-right direction when the plug is inserted into the socket. The connector assembly includes the plug and the socket.

20 Claims, 11 Drawing Sheets

PLUG AND CONNECTOR ASSEMBLY

CROSS-REFERENCE TO RELATED APPLICATIONS

This application is a continuation-in-part of U.S. application Ser. No. 15/923,025, which claimed the priorities to Chinese patent application No. 201720258731.5 filed on Mar. 16, 2017 and Chinese patent application No. 201720443445.6 filed on Apr. 1, 2017, the disclosures of which are incorporated herein by reference in their entireties.

TECHNICAL FIELD

The present disclosure relates to the technical field of connectors, and in particular, to a plug and a connector assembly.

BACKGROUND

In the field of electronic products such as smart TVs and 3C electronic products, various connectors are generally required to connect two electronic devices. A connector generally includes a plug and a socket mate with each other. The plug is inserted into the socket to achieve an electrical conduction between two electronic devices.

The plug includes a circuit board, an insulting body and a cable. The circuit board includes an inserting end which protrudes out of the insulting body and upper and lower surfaces of the inserting end are provided with metal contact fingers connected to the cable.

The socket includes an insulating seat body, a plurality of conductive terminals accommodated in the insulating seat body and a metal shell that encloses the insulating seat body. The insulating seat body is provided with a slot which matches with the inserting end to be inserted, and contact portions of the conductive terminals are distributed on upper and lower side walls of the slot. The inserting end is inserted into the slot and the metal contact fingers abut against the conductive terminals to be electrically connected to achieve conduction between the plug and the socket.

However, when the installation space of the connector in an electrical device is limited and a size of the plug is made to be very short, since the plug is easy to be inserted obliquely due to easiness to bend and deform of the cable at the time of inserting and pulling the plug, the circuit board mates with the contact portions of the conductive terminals and a risk of pin collapse exists.

Therefore, there is an urgent need for a plug and a connector assembly to solve the above technical problems.

SUMMARY

An object of the present disclosure is to provide a plug and a connector assembly capable of reducing a risk of pin collapse.

To achieve this object, the present disclosure adopts the technical solutions described below.

A technical solution 1 provides a plug. The plug includes an insulating body, a cable and a circuit board. The insulating body includes a body part and a mating part which extends forwardly from the body part. The cable and the circuit board are electrically connected. The circuit board has an inserting part which protrudes forwardly out of the mating part. An outer side of the mating part is provided with a limiting groove and a guiding wall disposed within the limiting groove, and the guiding wall is adjacent to the inserting part and is capable of guiding insertion of the plug into a socket and preventing the plug from shaking in an up-down direction and/or in a left-right direction when the plug is inserted into the socket.

Preferably, the guiding wall is aligned with a front end of the mating part.

Preferably, the limiting groove includes a first limiting groove and a second limiting groove; the insulting body has a first baffle plate and a second baffle plate which extend from the body part to the mating part. The first limiting groove is formed between the first baffle plate and the mating part and the second limiting groove is formed between the second baffle plate and the mating part.

The first baffle plate is disposed on a left side or a right side of the mating part, the second baffle plate is disposed on an upper side or a lower side of the mating part, and the guiding wall connects the first baffle plate or the second baffle plate to the mating part and is disposed within the first limiting groove or the second limiting groove.

Preferably, the guiding wall includes a first guiding wall and a second guiding wall.

The number of the first baffle plate is two and two first baffle plates are respectively disposed on the left side and the right side of the mating part, and at least one of the two first baffle plates is connected to the mating part through the first guiding wall.

Preferably, the width of the first guiding wall is less than the thickness of the mating part.

Preferably, the number of the second baffle plate is two and at least one of two second baffle plates is connected to the mating part through the second guiding wall.

Preferably, the first baffle plate and the second baffle plate protrude forwardly out of the mating part or the circuit board.

A technical solution 2 provides a plug. The plug includes an insulating body, a cable and a circuit board. The insulating body includes a body part and a mating part which extends forwardly from the body part. The cable and the circuit board are electrically connected. The circuit board has an inserting part which protrudes forwardly out of the mating part. The insulting body is provided with at least one baffle plate which extends from the body part to the mating part, each of the at least one baffle plate includes a first baffle plate and a second baffle plate separate from the first baffle plate.

The first baffle plate is disposed on a left side or a right side of the mating part, and a first limiting groove is formed between the first baffle plate and the mating part; and the second baffle plate is disposed on an upper side or a lower side of the mating part and a second limiting groove is formed between the second baffle plate and the mating part.

Preferably, the insulting body is provided with two baffle plates, and two first baffle plates of the two baffle plates are respectively disposed on the left side and the right side of the mating part.

Preferably, a limiting block is disposed within the first limiting groove on each side of the mating part, and the width of the limiting block is less than the thickness of the mating part.

Preferably, the baffle plate protrudes forwardly out of the mating part or the circuit board.

Preferably, the first baffle plate and the second baffle plate separate from each other are staggered in an up-down direction and in a left-right direction.

Preferably, an inner side wall of each of the first limiting groove and the second limiting groove is provided with a groove, and the groove penetrates forwardly through the mating part and the first baffle plate or the second baffle plate in a horizontal direction.

A technical solution 3 provides a connector assembly. The connector assembly includes a socket and the plug described above.

The socket includes an insulting seat body, conductive terminals accommodated in the insulating seat body, and a metal shell which encloses the insulating seat body. An end protruding out of the insulting seat body of the metal shell is provided with an inserting groove into which a mating part is inserted.

Preferably, a side wall of the metal shell is provided with a limiting gap which mates with a limiting block.

Preferably, the metal shell is provided with a guiding gap into which a guiding wall is inserted.

Preferably, the guiding gap includes a first gap and a second gap. The first gap is disposed on a side wall of the metal shell and mates with a first guiding wall. The second gap is disposed on an upper wall or a lower wall of the metal shell and mates with a second guiding wall.

Preferably, an inserting part is provided with metal contact fingers.

Preferably, the insulting seat body is provided with a slot into which the inserting part is inserted, the conductive terminals have respective contact portions which extend into the slot and contact with the metal contact fingers.

Preferably, an insulting body is provided with a latch piece, the metal shell is capable of being locked to the latch piece to fixedly connect the plug to the socket.

The present disclosure has the following beneficial effects: in the process of inserting the plug of the connector assembly into the socket, the first limiting groove and the second limiting groove of the plug or the guiding wall of the plug may limit and guide the plug, and mates with the metal shell of the socket to prevent the plug from shaking in the up-down direction and in the left-right direction. In this way, the plug can be effectively prevented from being obliquely inserted, thereby preventing the circuit board from damaging the contact portions of the conductive terminals and thus reducing the risk of pin collapse.

1. Plug; 11. Insulating body; 12. Cable; 13. Circuit board; 14. Latch piece;

111. Body part; 112. Mating part; 113. First baffle plate; 114. Second baffle plate; 115. First guiding wall; 116. Second guiding wall; 117. Limiting block; 118. Groove; 141. Elastic piece; 142. Pressing piece;

2. Socket; 21. Insulating seat body; 211. Slot; 22. Conductive terminal; 221. Contact portion; 23. Metal shell; 231. Limiting gap; 232. First gap; 233. Second gap; 234. Clamping groove; 235. Inserting groove.

DETAILED DESCRIPTION

The technical solutions of the present disclosure will be further described below through specific embodiments in conjunction with the drawings.

Embodiment 1

As shown in FIGS. 1 to 6, this embodiment provides a plug and a connector assembly. The connector assembly includes a plug 1 and a socket 2 mating with each other.

Figure 1:
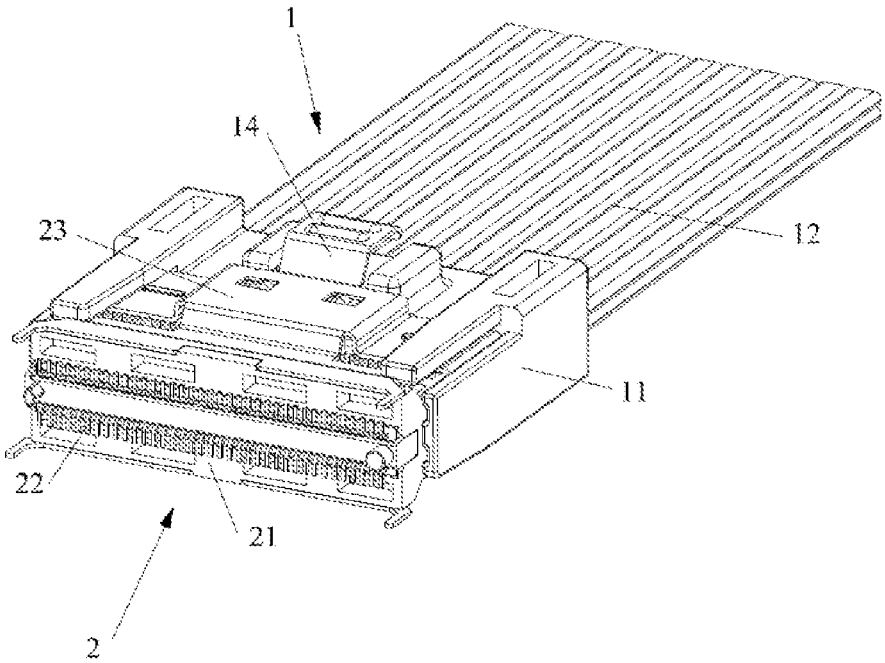
FIG. 1 is a structural diagram of a connector assembly according to an embodiment 1 of the present disclosure.
Figure 2:
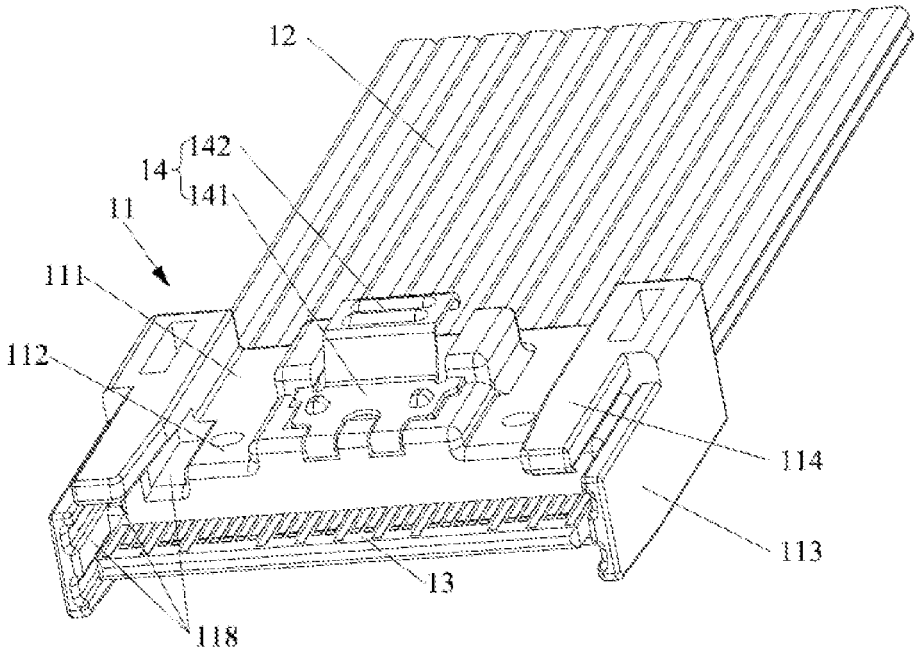
FIG. 2 is a structure diagram of a plug according to the embodiment 1 of the present disclosure.
Figure 3:
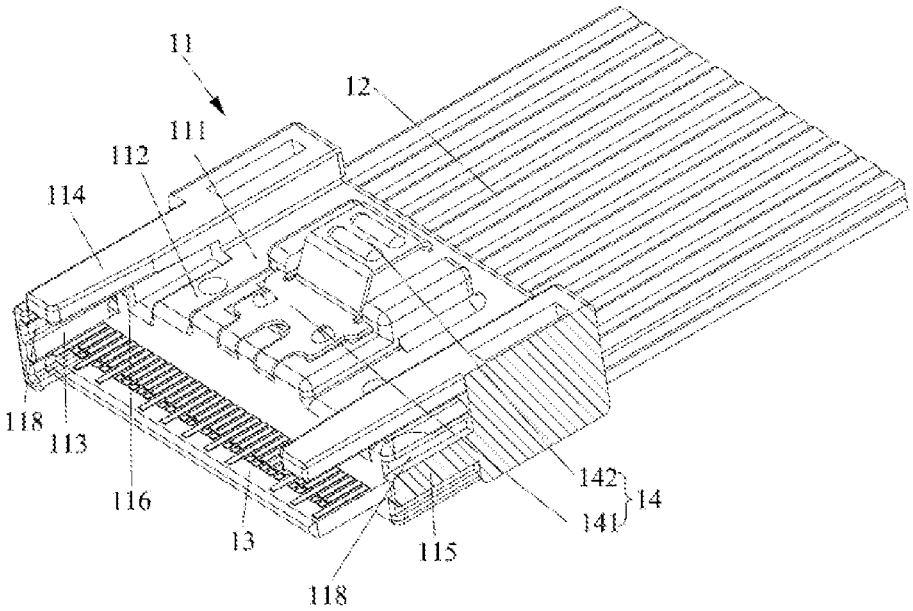
FIG. 3 is a structure diagram of the plug according to the embodiment 1 of the present disclosure (one first baffle plate is not shown)
Figure 4:
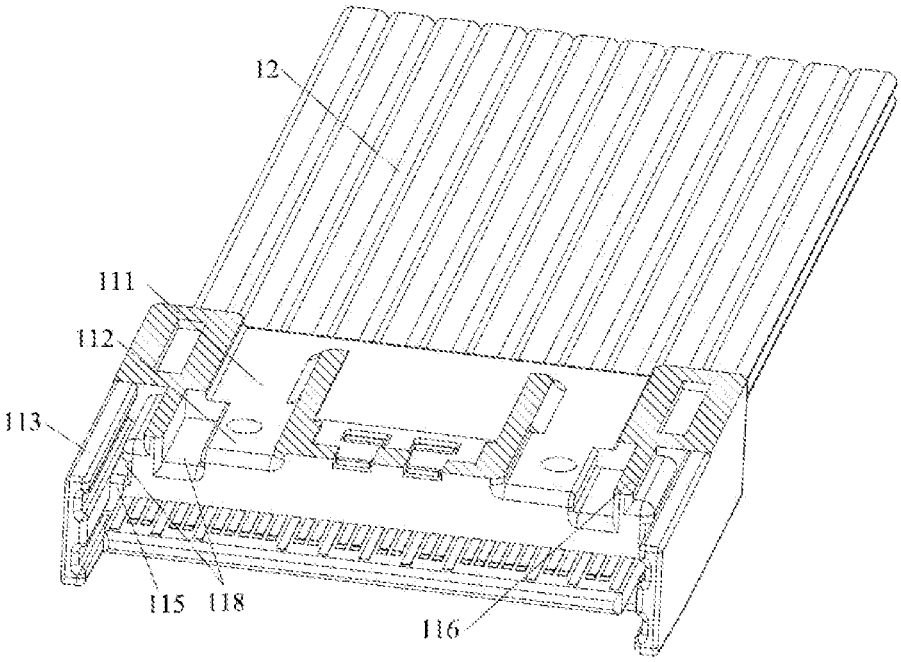
FIG. 4 is a structure diagram of the plug according to the embodiment 1 of the present disclosure (two second baffle plates are not shown)

As shown in FIGS. 2 to 4, the plug 1 includes an insulating body 11, a cable 12, a circuit board 13 and a latch piece 14. The insulating body 11 includes a body part 111 and a mating part 112 which extends forwardly from the body part 111. The insulating body 11 is provided with a receiving slot into which the circuit board 13 is inserted. A front end of the receiving slot is located within the mating part 112 and penetrates through the mating part 112 in a front-rear direction. A rear end of the receiving slot is located within the body part 111, and the portion of the receiving slot located within the body part 111 accommodates a rear end of the circuit board 13 and a part of the cable 12. The insulating body 11 is horizontally placed. A front end of the circuit board 13 protrudes out of the mating part 112 to form an inserting part of the plug 1. An upper side and a lower side of the inserting part are both provided with metal contact fingers. The rear end of the circuit board 13 is electrically connected to the cable 12. The cable 12 extends backwards and is exposed at a rear end of the insulating body 11 to be connected to another electronic device.

An outer side of the mating part 112 is provided with a limiting groove and a guiding wall disposed in the limiting groove. The guiding wall is adjacent to the inserting part. Specifically, the guiding wall extends from the body part 111 to the mating part 112 and is aligned with a front end of the mating part 112. The guiding wall includes a first guiding wall 115 disposed on a left side and/or a right side of the mating part 112 and a second guiding wall 116 disposed on an upper side and/or a lower side of the mating part 112.

A first baffle plate 113 and a second baffle plate 114 extend from the body part 111 to the mating part 112 and respectively have a front end protruding out of the circuit board 13. The front end of the first baffle plate 113 tends to be aligned with the front end of the second baffle plate 114. In another embodiment, the first baffle plate 113 and the second baffle plate 114 may protrude out of the mating part 112 instead of protruding out of the circuit board 13. A portion protruding out of the circuit board of the first baffle plate 113 and a portion protruding out of the circuit board of the second baffle plate 114 help to guide the plug 1 to enable the plug to be aligned with the socket when the inserting part of the plug 1 has not been in contact with the socket.

The limiting groove includes a first limiting groove and a second limiting groove. The first baffle plate 113 is disposed on the left side and/or the right side of the mating part 112. Preferably, in this embodiment, there are two first baffle plates 113 which are respectively disposed on the left side and the right side of the mating part 112, and the two first baffle plates 113 mates with side walls of the mating part 112 to form the first limiting grooves. Each first baffle plate 113 is connected to the mating part 112 through a first guiding wall 115. The first guiding wall 115 is disposed in the first limiting groove. The width of the first guiding wall 115 is less than the thickness of the mating part 112, that is, less than the width of a side wall of the mating part 112. The first guiding wall 115 is disposed on the mating part 112 and is centered in an up-down direction. The first guiding wall 115 can prevent the plug 1 from shaking up and down during insertion of the plug 1 into the socket 2. An inner wall of the first limiting groove is provided with a groove 118. The grooves 118 are arranged on and extend across an inner wall of the first baffle plate 113 and the side wall of the mating part 112, respectively, in the front-rear direction. Two grooves 118 are spaced in parallel on the inner wall of the first baffle plate 113 and the side wall of the mating part 112.

The second baffle plate 114 is disposed on the upper side and/or the lower side of the mating part 112. Preferably, in this embodiment, there are two second baffle plates 116. The two second baffle plates 114 are both disposed on the upper side of the mating part 112 and the second limiting grooves are formed between the two second baffle plates 114 and the mating part 112. Each second baffle plate 114 is connected to the mating part 112 through a second guiding wall 116. The width of the second guiding wall 116 is less than the width of the second baffle plate 114, and the second guiding wall 116 is centered with respect to the second baffle plate 114. The second guiding wall 116 can prevent the plug 1 from shaking left and right during insertion of the plug 1 the socket 2. An inner wall of the second limiting groove is also provided with a groove 118. The groove 118 is arranged on and extends across an upper wall of the mating part 112 in the front-rear direction.

In this embodiment, the second baffle plates 114 of the two baffle plates are disposed on both sides and adjacent to respective first baffle plates 113. One first baffle plate 113 and the second baffle plate 114 adjacent to this first baffle plate 113 are staggered in the up-down direction and in a left-right direction. Adjacent edges of one second baffle plate 114 and one first baffle plate 113 are disconnected from each other. In another embodiment, one first baffle plate 113 and the second baffle plate 114 adjacent to the this first baffle plate 113 are staggered in the up-down direction and in the left-right direction, and the other first baffle plate 113 and the other second baffle plate 114 are connected to each other. In yet another embodiment, the two first baffle plates are respectively connected to the second baffle plates adjacent to the first baffle plates.

Figure 5:
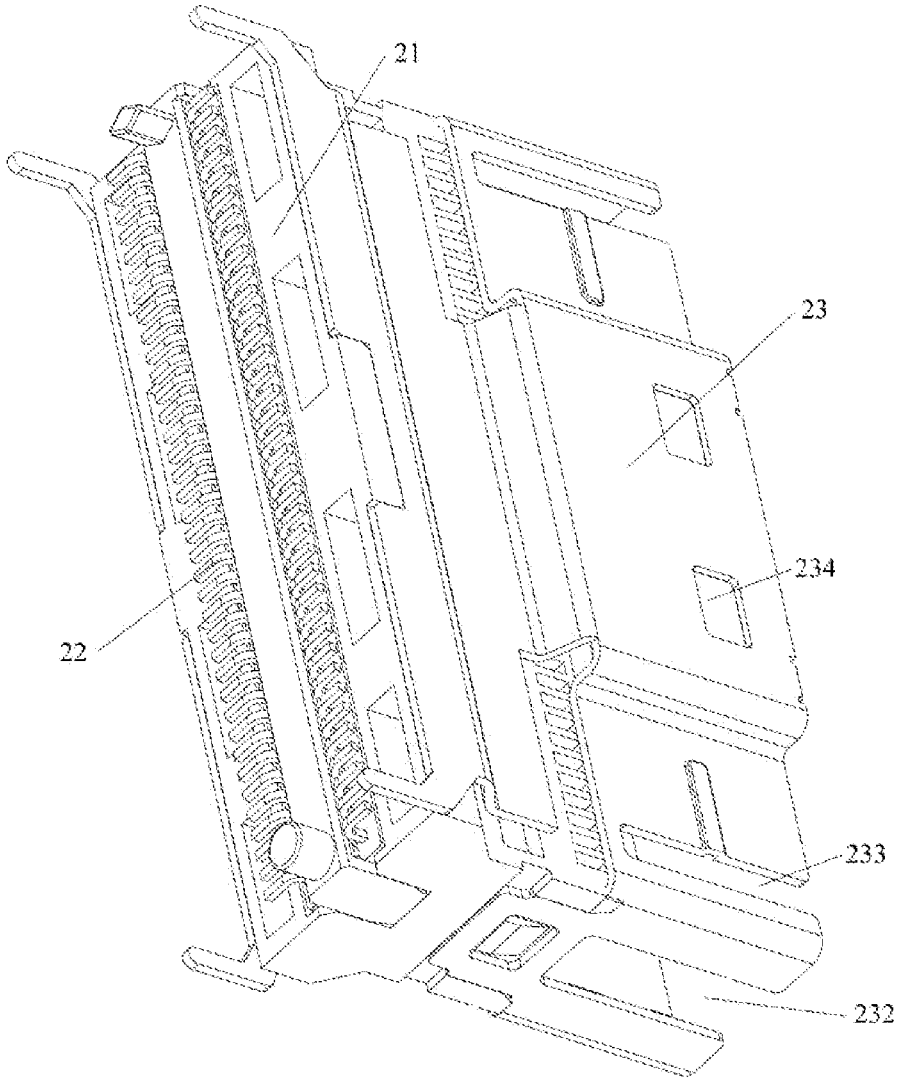
FIG. 5 is a structure diagram of a socket from an angle of view according to the embodiment 1 of the present disclosure.
Figure 6:
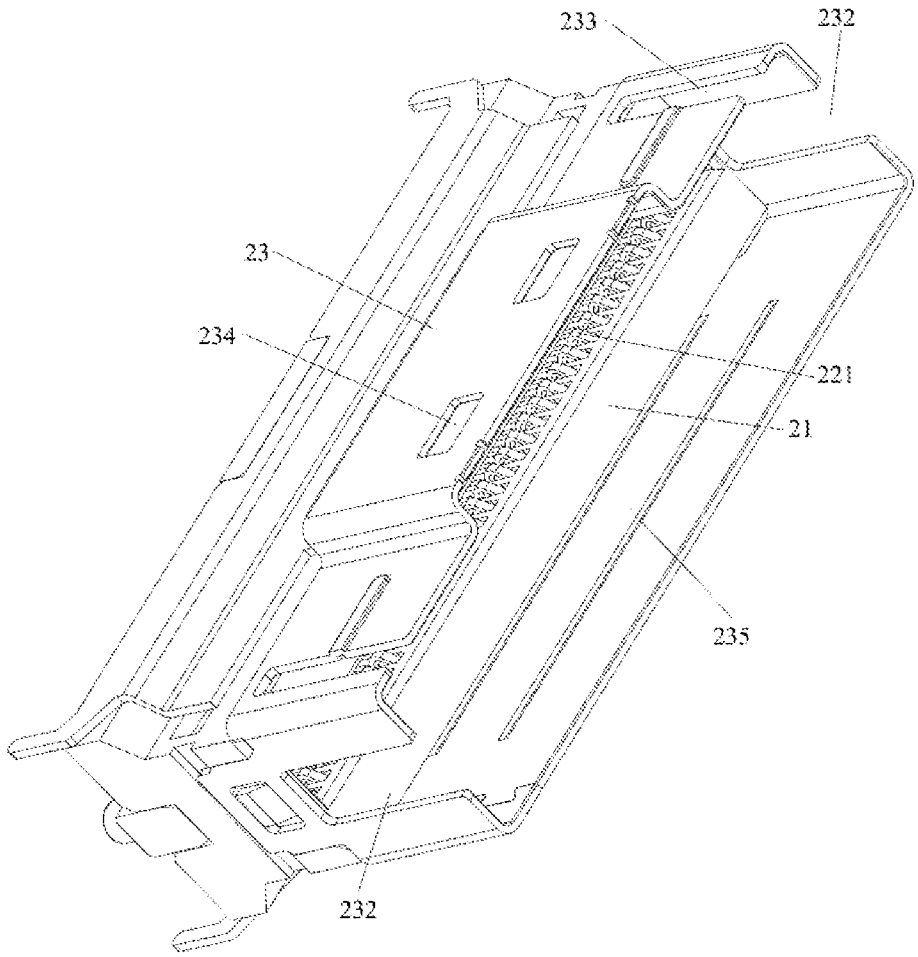
FIG. 6 is a structure diagram of the socket from another angle of view according to the embodiment 1 of the present disclosure.
Figure 7:
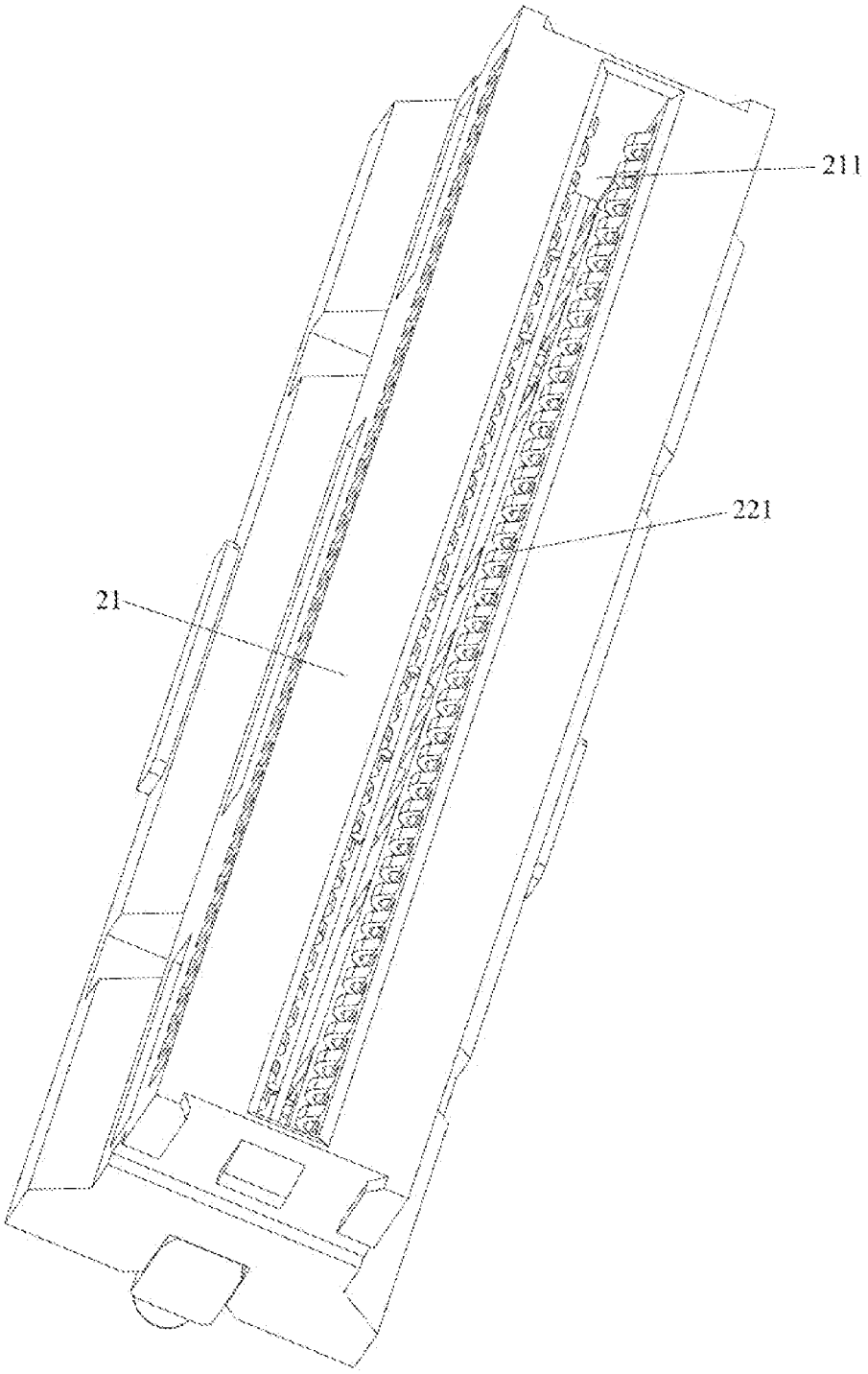
FIG. 7 is a structure diagram of the socket according to the embodiment 1 of the present disclosure (the metal shell is not shown)

As shown in FIGS. 5 to 7, the socket 2 includes an insulating seat body 21, conductive terminals 22 accommodated in the insulating seat body 21, and a metal shell 23 covering an outer side of the insulating seat body 21. The insulating seat body 21 is provided with a slot 211 into which the inserting part of the plug 1 is inserted. The conductive terminals 22 have contact portions 221 extending into the slot 211. The conductive terminals 22 are disposed in one-to-one correspondence with the metal contact fingers of the plug 1. Ends of the conductive terminals 22 which do not extend into the slot 211 are connected to a circuit board of an electronic device connected to the socket 2. After the plug 1 is inserted into the socket 2, the metal contact fingers abut against the contact portions 221 to achieve mutual conduction between the plug 1 and the socket 2.

The metal shell 23 includes an upper wall, a lower wall and two side walls covering the insulating seat body 21. The upper wall, the lower wall and the two side walls all protrude forwardly out of the insulating seat body 21, and portions protruding out of the insulating seat body 21 of the metal shell 23 encircle an inserting groove 235 into which the mating part 112 of the plug 1 is inserted. The walls of the metal shell 23 are provided with guiding gaps for the guiding walls to be inserted into. The guiding gaps include a first gap 232 and a second gap 233. Specifically, the side wall of the metal shell 23 is provided with the first gap 232 which mates with the first guiding wall 115; the upper wall of the metal shell 23 is provided with the second gap 233 which mates with the second guiding wall 116. After the plug 1 is inserted into the socket 2, the mating part 112 of the plug 1 is located in the inserting groove 235, the first gap 232 is locked to the first guiding wall 115, and the second gap 233 is locked to the second guiding wall 116.

When the plug 1 is inserted into the socket 2, a portion protruding out of the mating part 112 of the first baffle plate 113 and a portion protruding out of the mating part 112 of the second baffle plate 114 may guide and align the plug to enable the plug 1 to be aligned with the socket 2. During insertion of the plug 1 into the socket 2, the first guiding wall 115 and the second guiding wall 116 may limit and guide the plug 1 and mate with the first gap 231 and the second gap 232 of the metal shell 23 of the socket 2 to prevent the plug 1 from shaking in the up-down direction and in the left-right direction. In this way, the plug 1 can be effectively prevented from being obliquely inserted, thereby preventing the circuit board 13 from damaging the contact portions 221 of the conductive terminals 22 and reducing a risk of pin collapse. Furthermore, the first guiding wall 115 can increase connection strength of the first baffle plate 113, and the second guiding wall 116 can increase connection strength of the second baffle plate 114.

With continued reference to FIGS. 2 and 3, the latch piece 14 includes an elastic piece 141 and a pressing piece 142 connected to each other. A front end of the elastic piece 141 is fixed to an upper surface of the mating part 112, and the pressing piece 142 and the remaining portion of the elastic piece 141 hangs above the upper surface of the mating part 112. The elastic piece 141 is provided with two clamping bulges. The metal shell 23 is provided with two clamping grooves 234 (shown in FIGS. 5 and 6) which mate with the clamping bulges. After the plug 1 is inserted into the socket 2, the clamping bulges are clamped into the clamping grooves 234. When the plug 1 needs to be pulled out, the pressing piece of the latch piece 14 is pressed down to disengage the clamping bulges from the clamping grooves 234 and then the plug 1 is pulled out.

Embodiment 2

Figure 8:
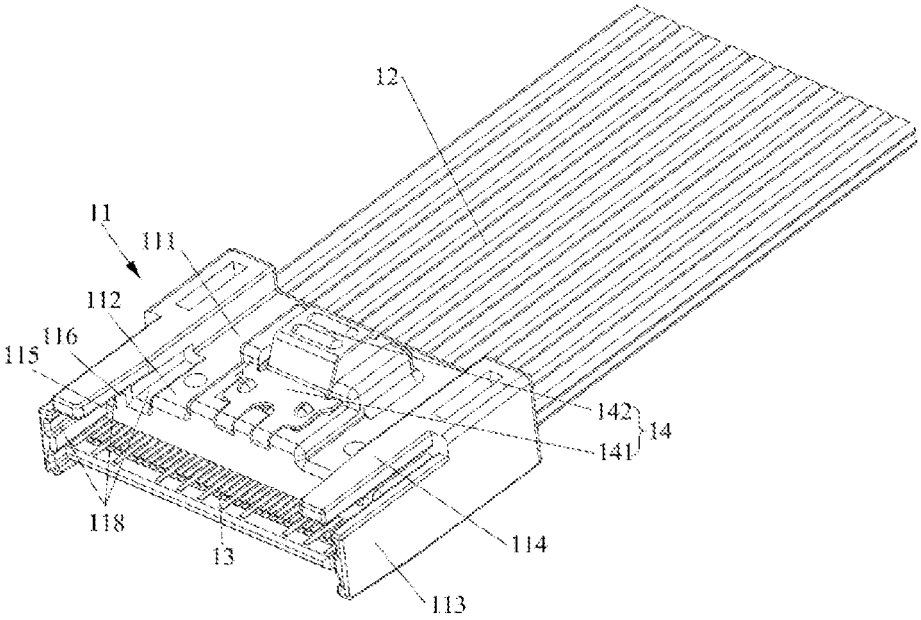
FIG. 8 is a structure diagram of a plug according to an embodiment 2 of the present disclosure.
Figure 9:
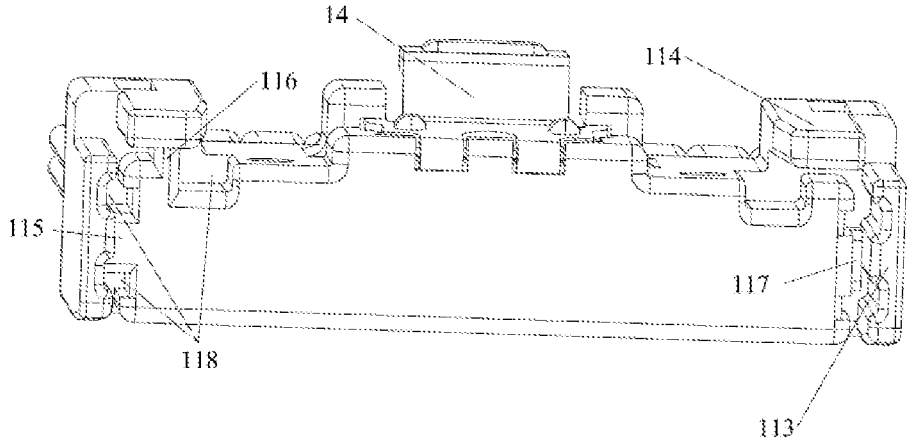
FIG. 9 is a structure diagram of the plug according to the embodiment 2 of the present disclosure (the circuit board is not shown)

As shown in FIGS. 8 to 9, this embodiment provides a connector assembly which includes a plug 1 and a socket 2. The plug 1 has a basically same structure to the plug 1 in the embodiment 1. The difference is that one first baffle plate 113 is not connected to the mating part 112 through the first guiding wall 115, but the one first baffle plate 113 and the mating part 112 are spaced to form a side limiting groove which penetrates through the insulating body 11 in an up-down direction. The body part 111 extends forwardly within the side limiting groove to form a limiting block 117. The second baffle plate 114 adjacent to the first baffle plate 113 is not connected to the mating part 112 through the second guiding wall 116, but the second baffle plate 114 and the mating part 112 are spaced to form an upper limiting groove which penetrates through the insulating body 11 in a left-right direction.

The metal shell 23 of the socket 2 is not provided with the first gap 232 and the second gap 233 at positions corresponding to the first baffle plate 113 and the second baffle plate 114, but is provided with a limiting gap at a position corresponding to the limiting block 117. A side limiting groove and an upper limiting groove of the plug 1 help to guide the metal shell 23.

Embodiment 3

As shown in FIGS. 10 to 14, this embodiment provides a plug and a connector assembly. The connector assembly includes a plug 1 and a socket 2 mating with each other.

Figure 10:
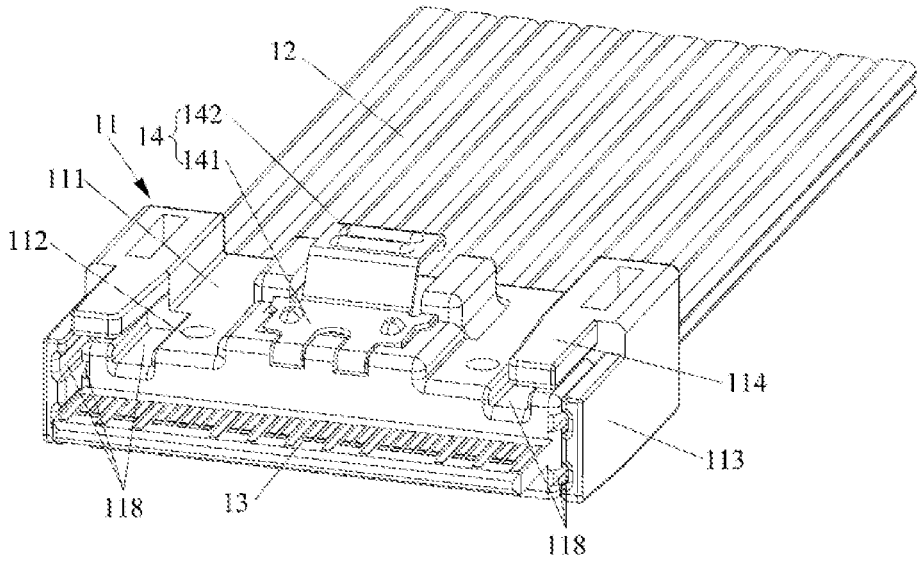
FIG. 10 is a structure diagram of a plug according to an embodiment 3 of the present disclosure.
Figure 11:
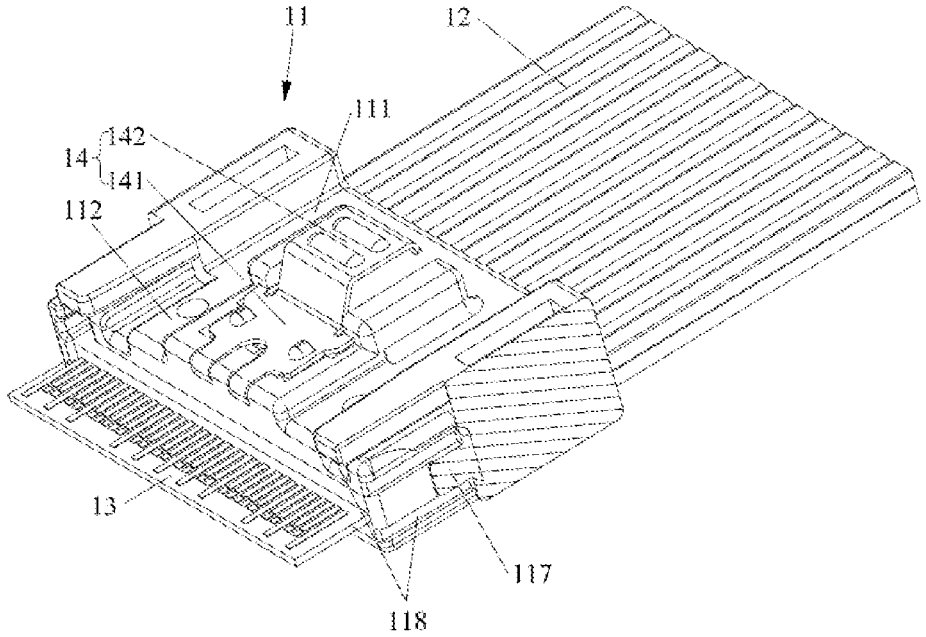
FIG. 11 is a structure diagram of the plug according to the embodiment 3 of the present disclosure (one first baffle plate is not shown)

As shown in FIGS. 10 to 11, the plug 1 includes an insulating body 11, a cable 12, a circuit board 13 and a latch piece 14. The insulating body 11 includes a body part 111 and a mating part 112 which extends forwardly from the body part 111. The insulating body 11 is provided with a receiving slot into which the circuit board 13 is inserted. A front end of the receiving slot is located within the mating part 112 and extends across the mating part 112 in a front-rear direction. A rear end of the receiving slot is located within the body part 111, and a portion located within the body part 111 accommodates a rear end of the circuit board 13 and a part of the cable 12. The insulating body 11 is horizontally placed. A front end of the circuit board 13 protrudes out of the mating part 112 to form an inserting part of the plug 1. An upper side and a lower side of the inserting part are both provided with metal contact fingers. The rear end of the circuit board 13 is electrically connected to the cable 12. The cable 12 extends backwards and is exposed at a rear end of the insulating body 11 to be connected to another electronic device.

The insulating body 11 is provided with at least one baffle plate which extends from the body part 111 to the mating part 112, and a front end of the at least one baffle plate protrudes out of the mating part 112 instead of protruding out of the circuit board 13. In this embodiment, the insulating body 11 is provided with two baffle plates. In another embodiment, only one baffle plate may be disposed. A portion protruding out of the mating part 112 of the baffle plate helps to align and guide the plug 1. Each baffle plate includes a first baffle plate 113 and a second baffle plate 114 disposed in perpendicular to each other. The first baffle plate 113 and the second baffle plate 114 are disconnected; the first baffle plate 113 and the second baffle plate 114 are staggered in an up-down direction and in a left-right direction. Adjacent edges of the first baffle plate 113 and the second baffle plate 114 are disconnected from each other. That is, a gap exists at a corner between the first baffle plate 113 and the second baffle plate 114. The gap therebetween helps to observe an insertion degree of the plug 1.

The first baffle plates 113 of the two baffle plates are respectively disposed on a left side and a right side of the mating part 112. Each first baffle plate 113 is spaced in parallel from a side wall of the mating part 112. The first baffle plate 113 mates with the side wall of the mating part 112 to form a first limiting groove for guiding insertion of the plug 1. A limiting block 117 extends from a left side or a right side of the body part 111 to the mating part 112, and the limiting block 117 is disposed within the first limiting groove. The width of the limiting block 117 is less than the thickness of the mating part 112, that is, the width of a side surface of the mating part 112. A front end of the limiting block 117 has a certain distance from a front end of the mating part 112. The limiting block 117 is centered in the up-down direction with respect to the mating part 112, and the front end of the limiting block 117 is located within the first limiting groove. An inner wall of the first limiting groove is provided with a groove 118. The groove 118 is arranged on and extends across an inner wall of the first baffle plate 113 and the side wall of the mating part 112 in the front-rear direction. Two grooves 118 are spaced in parallel on the inner wall of the first baffle plate 113 and the side wall of the mating part 112.

The second baffle plate 114 is disposed on an upper side and a lower side of the mating part 112. In this embodiment, the second baffle plates 114 in the two baffle plates are both disposed on the upper side of the mating part 112. Each second baffle plate 114 is spaced in parallel from an upper wall (upper surface) of the mating part 112. The second baffle plate 114 mates with the upper wall of the mating part 112 to form a second limiting groove for guiding insertion of the plug 1 into the socket. The insulating body 11 is integrally formed by injection molding and is made of plastic. An inner wall of the second limiting groove is also provided with a groove 118. The groove 118 is arranged on and extends across the upper wall of the mating part 112 in the front-rear direction.

Figure 12:
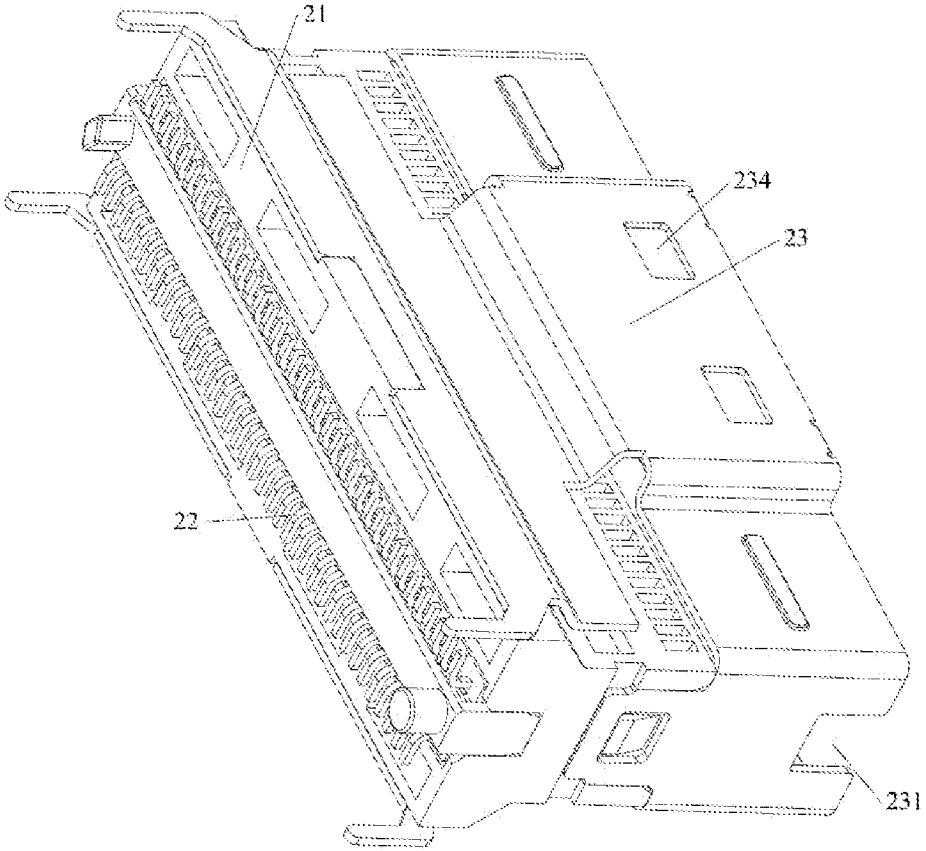
FIG. 12 is a structure diagram of a socket from an angle of view according to the embodiment 3 of the present disclosure.
Figure 13:
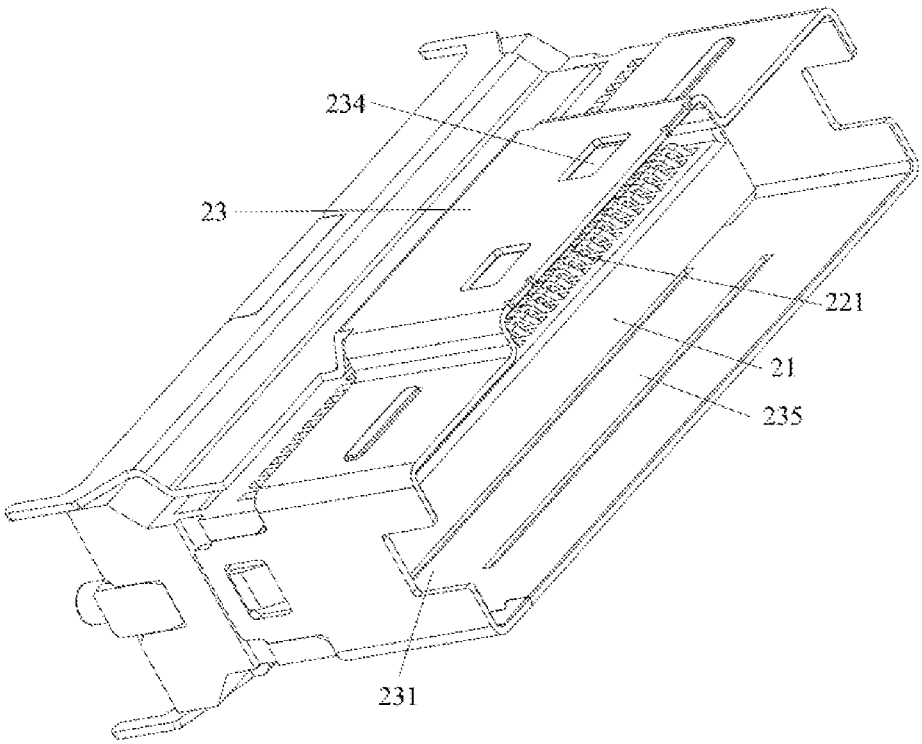
FIG. 13 is a structure diagram of the socket from another angle of view according to the embodiment 3 of the present disclosure.
Figure 14:
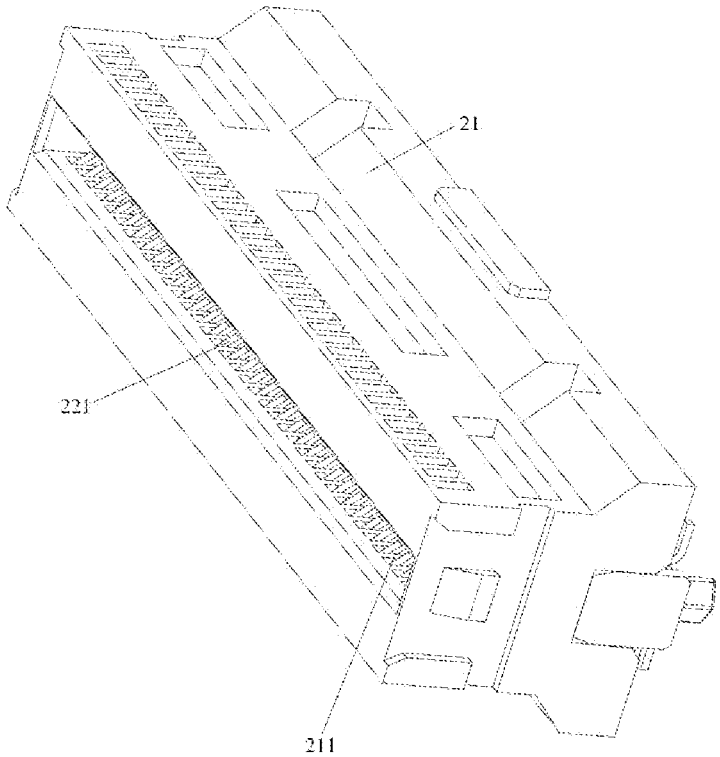
FIG. 14 is a structure diagram of the socket according to the embodiment 3 of the present disclosure (the metal shell is not shown)

As shown in FIGS. 12 to 14, the socket 2 includes an insulating seat body 21, conductive terminals 22 accommodated in the insulating seat body 21 and a metal shell 23 covering the insulating seat body 21. The insulating seat body 21 is provided with a slot 211 into which the inserting part of the plug 1 is inserted. The conductive terminals 22 have contact portions 221 extending into the slot 211. The conductive terminals 22 are disposed in one-to-one correspondence with the metal contact fingers of the plug 1. Ends of the conductive terminals 22 which do not extend into the slot 211 are connected to a circuit board of an electronic device connected to the socket 2. After the plug 1 is inserted into the socket 2, the metal contact fingers abut against the contact portions 221 to achieve mutual conduction between the plug 1 and the socket 2. The metal shell 23 includes an upper wall, a lower wall and two side walls covering the insulating seat body 21. The upper wall, the lower wall and the two side walls all protrude forwardly out of the insulating seat body 21, and portions protruding out of the insulating seat body 21 of the metal shell 23 encircle an inserting groove 235 into which the mating part 112 of the plug 1 is inserted. A side wall of the metal shell 23 is provided with a limiting gap 231 which mates with the limiting block 117. After the plug 1 is inserted into the socket 2, the limiting gap 231 mates with the limiting block 117 to prevent the plug 1 from shaking up and down in the socket 2.

With continued reference to FIGS. 10 and 11, the latch piece 14 includes an elastic piece 141 and a pressing piece 142 connected to each other. A front end of the elastic piece 141 is fixed to the upper surface of the mating part 112, and the pressing piece 142 and the remaining portion of the elastic piece 141 hangs above the upper surface of the mating part 112. The elastic piece 141 is provided with two clamping bulges. The metal shell 23 is provided with two clamping grooves 234 (shown in FIGS. 12 and 13) mating with the clamping bulges. After the plug 1 is inserted into the socket 2, the clamping bulges are clamped into the clamping grooves 234. When the plug 1 needs to be pulled out, the pressing piece of the latch piece 14 is pressed down to disengage the clamping bulges from the clamping grooves 234 and then the plug 1 is pulled out.

When the plug 1 is inserted into the socket 2, the first baffle plates 113 and the second baffle plates 114 may limit and align the plug to enable the plug 1 to be aligned with the socket 2. During insertion of the plug 1 into the socket 2, the first limiting groove and the second limiting groove may limit and guide the side wall of the metal shell 23 and mate with the metal shell 23 of the socket 2 to prevent the plug 1 from shaking in the up-down direction and in the left-right direction. In this way, the plug 1 can be effectively prevented from being obliquely inserted, thereby preventing the circuit board 13 from damaging the contact portions 221 of the conductive terminals 22 and reducing a risk of pin collapse.

Embodiment 4

Figure 15:
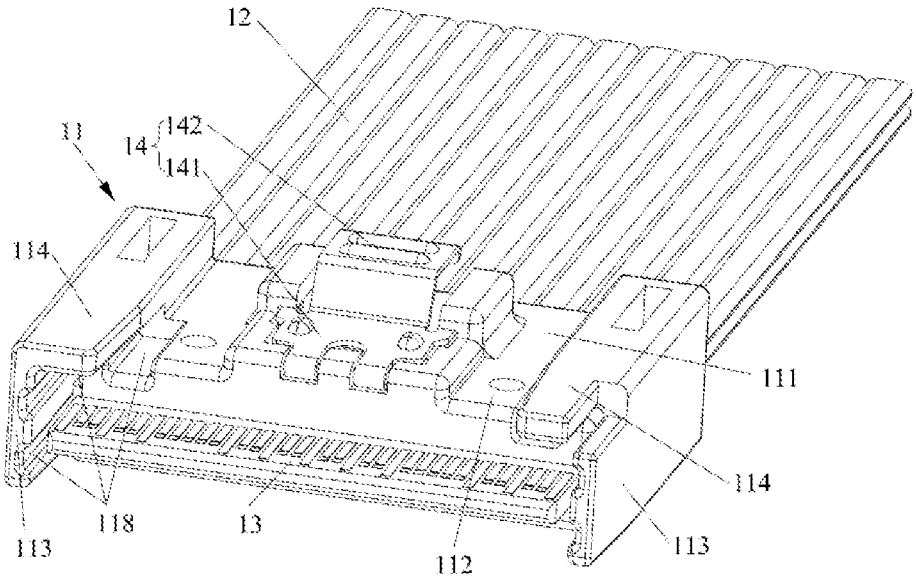
FIG. 15 is a structure diagram of a plug according to an embodiment 4 of the present disclosure.
Figure 16:
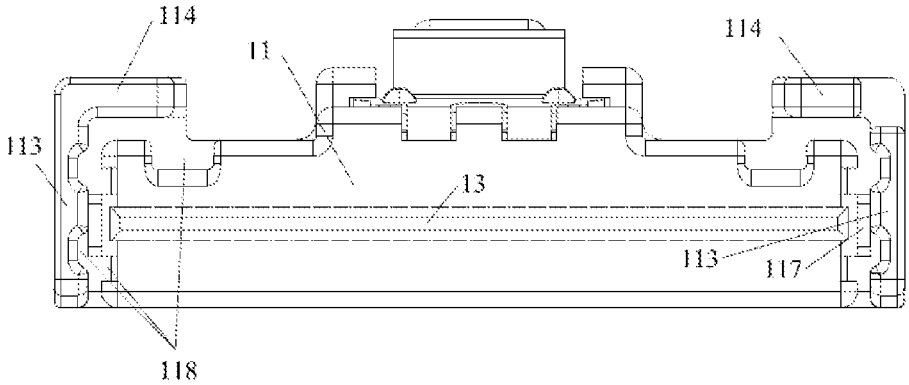
FIG. 16 is a structure diagram of the plug according to the embodiment 4 of the present disclosure (the circuit board is not shown).

As shown in FIGS. 15 to 16, this embodiment provides a connector assembly which includes a plug 1 and a socket 2. The socket 2 has the same structure as the socket 2 in the embodiment 3. The plug 1 has a basically same structure to the plug 1 in the embodiment 1. The difference is that the first baffle plate 113 and the second baffle plate 114 in one baffle plate are not spaced, but are integrally formed. Furthermore, the baffle plates protrude forwardly out of the circuit board 13, which enables the plug 1 to be aligned with the socket 2 before the inserting part of the plug 1 is inserted into the inserting groove 235.

Apparently, the above embodiments of the present disclosure are merely illustrative of the present disclosure and are not intended to limit the embodiments of the present disclosure. For those skilled in the art, alterations or modifications in other different forms can be made based on the above description. Embodiments of the present disclosure cannot be and do not need to be exhausted herein. Any modifications, equivalent replacements and improvements within the spirit and principle of the present disclosure fall within the scope of the claims of the present disclosure.

What is claimed is:

1. A plug, comprising an insulating body, a cable and a circuit board, wherein the insulating body comprises a body part and a mating part which extends forwardly from the body part, the cable and the circuit board are electrically connected, the circuit board has an inserting part which protrudes forwardly out of the mating part, an outer side of the mating part is provided with a limiting groove and a guiding wall disposed within the limiting groove, and the guiding wall is adjacent to the inserting part and is capable of guiding insertion of the plug into a socket and preventing the plug from shaking in an up-down direction and/or in a left-right direction when the plug is inserted into the socket.

2. The plug according to claim 1, wherein the guiding wall is aligned with a front end of the mating part.

3. The plug according to claim 1, wherein the limiting groove comprises a first limiting groove and a second limiting groove, the insulating body has a first baffle plate and a second baffle plate which extend from the body part to the mating part, the first limiting groove is formed between the first baffle plate and the mating part and the second limiting groove is formed between the second baffle plate and the mating part;

wherein the first baffle plate is disposed on a left side or a right side of the mating part, the second baffle plate is disposed on an upper side or a lower side of the mating part, and the guiding wall connects the first baffle plate or the second baffle plate to the mating part and is disposed within the first limiting groove or the second limiting groove.

4. The plug according to claim 3, wherein the guiding wall comprises a first guiding wall and a second guiding wall;

wherein a number of the first baffle plate is two and two first baffle plates are respectively disposed on the left side and the right side of the mating part, and at least one of the two first baffle plates is connected to the mating part through the first guiding wall.

5. The plug according to claim 4, wherein a width of the first guiding wall is less than a thickness of the mating part.

6. The plug according to claim 4, wherein a number of the second baffle plate is two and at least one of two second baffle plates is connected to the mating part through the second guiding wall.

7. The plug according to claim 3, wherein the first baffle plate and the second baffle plate protrude forwardly out of the mating part or the circuit board.

8. The plug according to claim 3, wherein an inner side wall of each of the first limiting groove and the second limiting groove is provided with a groove, the groove extends across the mating part and the first baffle plate or the second baffle plate in a horizontal direction.

9. A plug, comprising an insulating body, a cable and a circuit board, wherein the insulating body comprises a body part and a mating part which extends forwardly from the body part, the cable and the circuit board are electrically connected, the circuit board has an inserting part which protrudes forwardly out of the mating part, the insulating body is provided with at least one baffle plate which extends from the body part to the mating part, each of the at least one baffle plate comprises a first baffle plate and a second baffle plate separate from the first baffle plate;

wherein the first baffle plate is disposed on a left side or a right side of the mating part, and a first limiting groove is formed between the first baffle plate and the mating part; and the second baffle plate is disposed on an upper side or a lower side of the mating part, and a second limiting groove is formed between the second baffle plate and the mating part.

10. The plug according to claim 9, wherein the insulating body is provided with two baffle plates, and two first baffle plates of the two baffle plates are respectively disposed on the left side and the right side of the mating part.

11. The plug according to claim 10, wherein a limiting block is disposed within the first limiting groove on each side of the mating part, and a width of the limiting block is less than a thickness of the mating part.

12. The plug according to claim 9, wherein the baffle plate protrudes forwardly out of the mating part or the circuit board.

13. The plug according to claim 9, wherein the first baffle plate and the second baffle plate separate from each other are staggered in an up-down direction and in a left-right direction.

14. The plug according to claim 9, wherein an inner side wall of each of the first limiting groove and the second limiting groove is provided with a groove, the groove extends across the mating part and the first baffle plate or the second baffle plate in a horizontal direction.

15. A connector assembly, comprising a socket and the plug according to claim 1;

wherein the socket comprises an insulating seat body, a plurality of conductive terminals accommodated in the insulating seat body, and a metal shell which encloses the insulating seat body, an end protruding out of the insulating seat body of the metal shell is provided with an inserting groove into which a mating part is inserted.

16. The connector assembly according to claim 15, wherein a side wall of the metal shell is provided with a limiting gap which mates with a limiting block.

17. The connector assembly according to claim 15, wherein the metal shell is provided with a guiding gap into which a guiding wall is inserted, wherein the guiding gap comprises a first gap and a second gap, the first gap is disposed on a side wall of the metal shell and mates with a first guiding wall, the second gap is disposed on an upper wall or a lower wall of the metal shell and mates with a second guiding wall.

18. The connector assembly according to claim 15, wherein an inserting part is provided with a plurality of metal contact fingers, wherein the insulating seat body is provided with a slot into which the inserting part is inserted, the conductive terminals have respective contact portions which extend into the slot and contact with the metal contact fingers.

19. The connector assembly according to claim 15, wherein an insulating body is provided with a latch piece, the metal shell is capable of being locked to the latch piece to fixedly connect the plug to the socket.

20. A connector assembly, comprising a socket and the plug according to claim 9;

wherein the socket comprises an insulating seat body, a plurality of conductive terminals accommodated in the insulating seat body, and a metal shell which encloses the insulating seat body, an end protruding out of the insulating seat body of the metal shell is provided with an inserting groove into which a mating part is inserted.

* * * * *